United States Patent [19]

Nakano et al.

[11] Patent Number: 4,827,574

[45] Date of Patent: May 9, 1989

[54] DEVICE FOR REMOVING SHORT FIBERS

[75] Inventors: Yuzuru Nakano, Takarazuka; Syunichi Tabata; Hiroaki Yamaguchi, both of Osaka; Hiroshi Araki, Shizuoka; Akira Kondo, Nagoya; Shinzo Nishimura, Bisai; Yoshiaki Yamaoka, Kariya; Akihiko Takeshita, Kyoto; Yoji Yamada, Ichinomiya, all of Japan

[73] Assignee: Japan Cotton Technical and Economic Research Institute of Mengyokaikan, Japan

[21] Appl. No.: 166,719

[22] Filed: Mar. 11, 1988

[30] Foreign Application Priority Data

Mar. 19, 1987 [JP] Japan ..... 62-66690
Jan. 13, 1988 [JP] Japan ..... 63-6571

[51] Int. Cl.[4] ..... D01G 1/00

[52] U.S. Cl. ..... 19/200; 19/98; 19/106 R; 19/205; 209/127.1; 209/130

[58] Field of Search ..... 19/200, 204, 205, 106 R, 19/98; 209/127.1, 127.4, 129, 130, 131

[56] References Cited

U.S. PATENT DOCUMENTS 3,111,719 11/1963 Novotny ..... 19/200
3,319,302 5/1967 Schmauder ..... 19/106 R
3,341,008 9/1967 Mayer et al. ..... 209/127.1 X
3,346,110 10/1967 LaFranca et al. ..... 209/127.1 X
3,349,902 10/1967 LaFranca et al. ..... 209/127.1 X
3,396,433 8/1968 Roxlo ..... 19/304
3,489,279 1/1970 St. John ..... 209/130
3,996,731 12/1976 Koella ..... 19/106 R

*Primary Examiner*—Louis K. Rimrodt
*Attorney, Agent, or Firm*—Barnes, Kisselle, Raisch, Choate, Whittemore & Hulbert

[57] ABSTRACT

This invention relates to a device for removing short fibers from a mass of fibers. A pair of perforated cylindrical bodies are opposed to each other with a predetermined spacing defined therebetween, and static electricity is applied across the perforated cylindrical bodies. A suction-wise removing device is installed in at least one of the perforated cylindrical bodies. The initial end of a transfer conveyor is located on the surface of one perforated cylindrical body adjacent the opposed region. Short fibers contained in the mass of fibers fed to the opposed region by a feeding device are drawn into the suction-wise removing devices through the through holes in the cylindrical bodies by the action of electrostatic force and suction air currents. The mass of fibers having the short fibers removed therefrom are oriented by electrostatic force and transferred by the conveyor while being maintained in this oriented state.

9 Claims, 5 Drawing Sheets

DEVICE FOR REMOVING SHORT FIBERS

FIELD OF THE INVENTION

The present invention relates to a device for removing short fibers from a mass of fibers by utilizing static electricity. The term "short fibers" as used herein refers to fibers having lengths to be calculated as the short fiber content factor specified in JISL 1019 (Japaneses Industrial Standard, class L, No. 1019)

BACKGROUND OF THE INVENTION

In the spinning process, to produce a yarn of good quality, it is important to remove short fibers which are mixed in amounts not less than several percent in a mass of fibers used as raw material and to form a bunch of fibers which are as parallel as possible. The most common means for removing short fibers that is now in use in mechanical means such as extracting or combing action on fibers or a bunch of fibers gripped at one of their respective ends as in a carding or combing machine.

Besides the mechanical means described above, a method using static electricity is proposed in the June 1966 issue of the Textile World magazine. This utilizes a non-uniform electrostatic field; one of the opposed electrodes is shaped in the form of a planar surface and the other in the form of a curved surface which is a part of an oval, and these electrodes are disposed so that the distance therebetween gradually changes. The potential across the two electrodes linearly changes in reverse proportion to the distance between the electrodes.

In actual operation of such means utilizing static electricity, individual fibers are fed to a place between the electrodes where the intensity of the electrostatic field is lowest. As a result, these fibers are arranged along the direction of the force between the electrodes and are attracted toward a place of greater electrostatic field intensity. In this case, longer fibers are moved faster than short fibers toward said place of greater electrostatic field intensity. Short fibers are not attracted toward said place of greater electrostatic field intensity so easily as longer fibers and instead they remain in a place of less electrostatic field intensity for a long period of time. This principle makes it possible to separate fibers according to their lengths and to remove short fibers between the electrodes.

In the case of mechanical means among said conventional means for removing short fibers from a mass of fibers, breaks of fibers easily take place; thus, at the same time as short fibers are removed, new short fibers and naps are formed. Therefore, it is very difficult to reduce the short fiber content to less than a certain value. Other problems are that the amount of short fibers to be removed increases and that hooks form on fibers, thus detracting from the parallelism of fibers. Further, in the case of electrostatic means, short fibers tend to remain in a place of less electrostatic field intensity for a long period of time and short fibers lingering between the electrodes gather together and are connected in long-fiber form, sometimes moving toward long fibers; thus, there is a problem that the efficiency of removal of short fibers not satisfactorily high.

DISCLOSURE OF THE INVENTION

An object of the invention is to provide a short fiber removing device which, with attention paid to the electrostatic means for removal of short fibers from a group of fibers, overcomes the problems in the prior art described above.

According to the invention, a device for removing short fibers from a mass of fibers comprises:

a pair of perforated cylindrical body opposed to each other with a predetermined spacing therebetween, means disposed in the rotation-upstream side of the opposed region of said pair of perforated cylindrical body, said means being capable of feeding said mass of fibers, means applying static electricity of high voltage across said pair of perforated cylindrical bodies so as to orient and hold long fibers contained in said mass of fibers approximately perpendicularly to the peripheral surfaces of the perforated cylindrical bodies, while reciprocating short fibers contained in said mass of fibers between the perforated cylindrical bodies, means disposed inside at least one of said perforated cylindrical bodies for suction-wise removing said short fibers reciprocating between said perforated cylindrical bodies through the through holes therein, and conveyor means for delivering the mass of fibers, having the short fibers removed therefrom, from the surface of one perforated cylindrical body adjacent said opposed region while maintaining them in said oriented state.

In the arrangement described above, the individual fibers in the mass of fibers fed by the feed means are held between the perforated cylindrical bodies approximately perpendicularly to their peripheral surfaces of the perforated cylindrical bodies by electrostatic attractive force. Fibers having greater length are connected in series to bridge the gap between the opposed peripheral surfaces and in this state they are moved with the rotation of the cylindrical bodies and delivered, rather than remaining, in web form oriented lengthwise of fibers from the surfaces of the perforated cylindrical bodies by the fiber delivery conveyor means. On the other hand, short fibers are reciprocated between the perforated cylindrical bodies by the electrocstatic attractive force and suction-wide removed through the through holes by suction air currents. Therefore, short fibers can be efficiently removed without damaging fibers and a bunch of well-oriented fibers can be obtained.

DESCRIPTION OF THE PREFERRED EMBODIMENTS

A first embodiment of the invention will now be described with reference to FIGS. 1 through 3.

Figure 3:
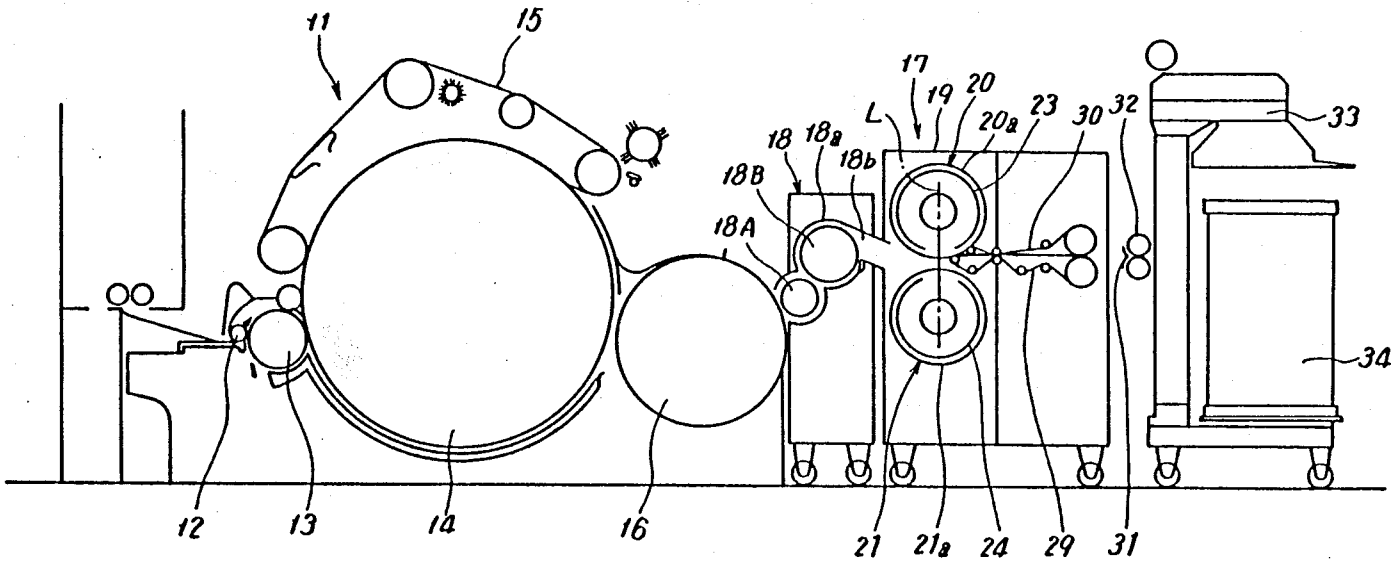
FIG. 3 is a schematic side view showing the device of FIG. 1 connected to a carding machine and to a fiber mass opening and feeding device.

In FIG. 3, the numeral 11 denotes a carding machine comprising a feed roller 12, a taker-in roller 13, a cylinder 14, flats 15 and a doffer 16, and disposed adjacent the doffer 16 of said carding machine 11 is a fiber mass opening and feeding device 18 associated with a short fiber removing device 17. (The term "opening" as used herein refers to a process in which a fiber is separated from a tuft.) The fiber mass opening and feeding device 18 comprises a doffing roller 18A for doffing a web accumulated on the surface of the doffer 16 of the carding machine 11, and a known opening roller 18B rotating at high speed whose surface is formed of a metallic card cloth or the like for opening a doffed web into single fibers and passing the latter to the next process. The doffing roller 18A and opening roller 18B are surrounded with a cover **18*a***.

Figure 1:
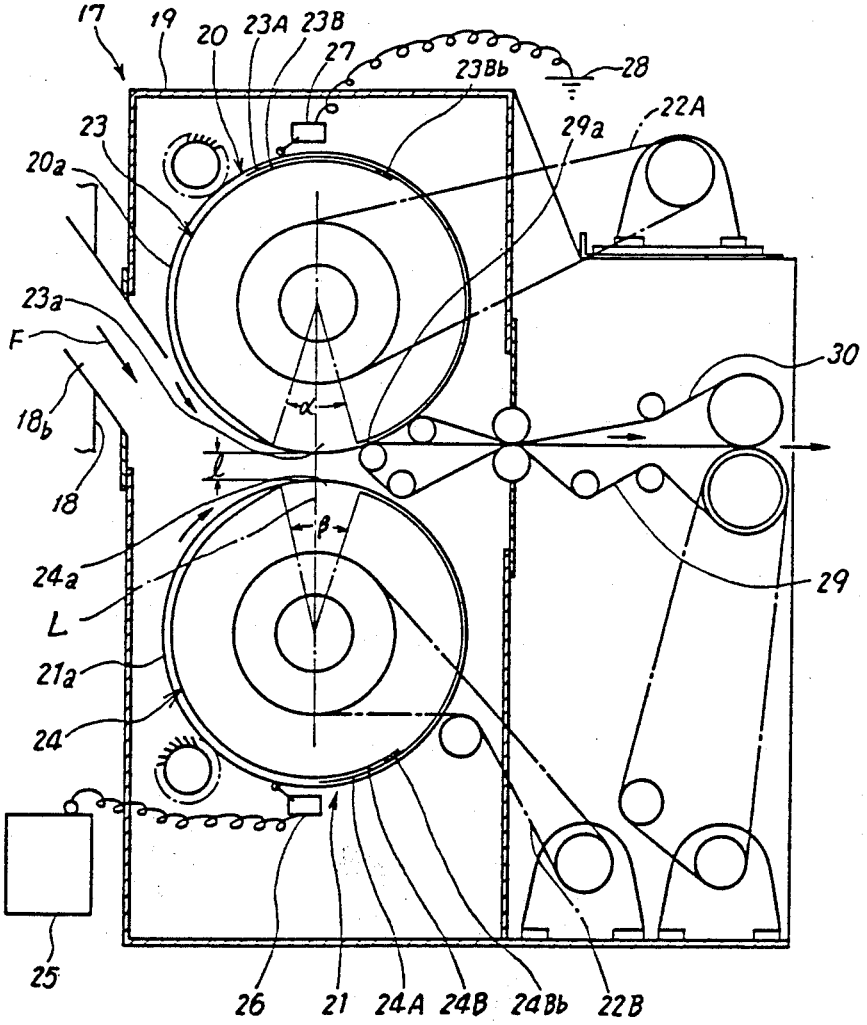
FIG. 1 is a schematic sectional view of the principal portion of a first embodiment of a short fiber removing device of the invention.
Figure 2:
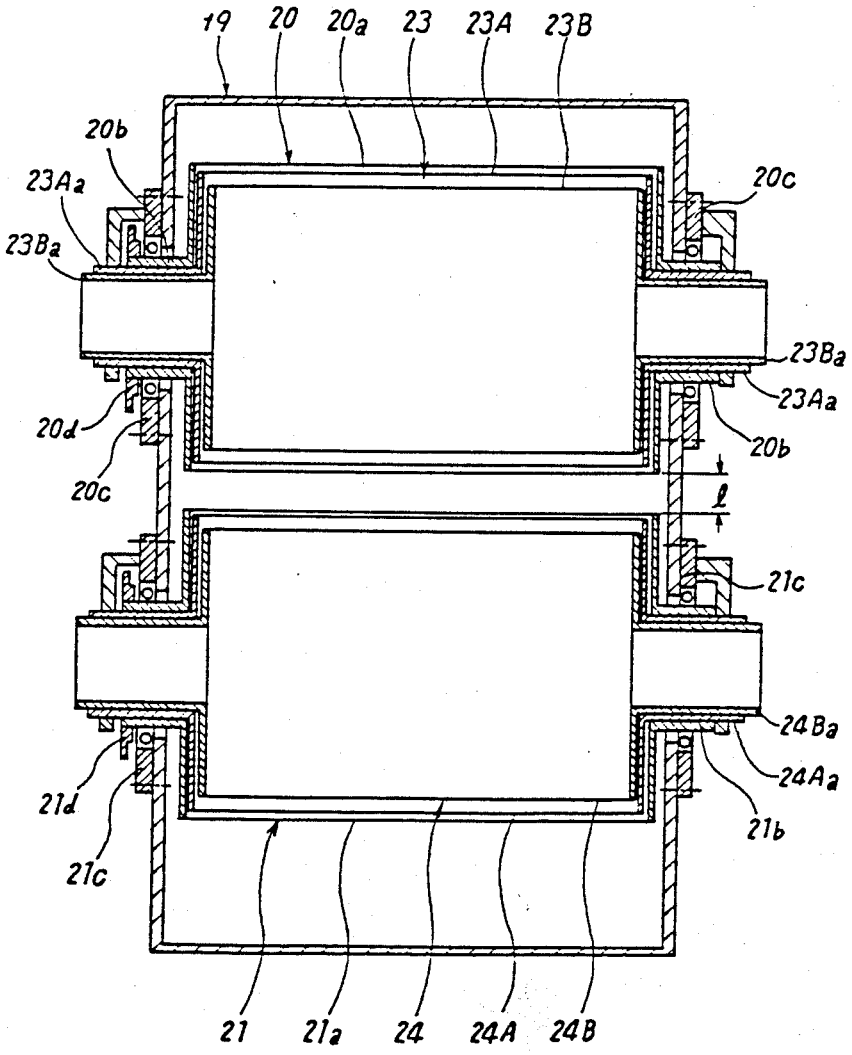
FIG. 2 is a longitudinal sectional view of the principal portion of the device of FIG. 1.

As shown in FIGS. 1 through 3, in the short fiber removing device 17, a pair of perforated cylindrical bodies 20 and 21 formed of a perforated metal or the like are installed in a frame 19 adjacent the fiber mass opening and feeding device 18. The perforated cylindrical bodies 20 and 21 are disposed in parallel relationship one above the other with their rotary axes extending horizontal, with a predetermined spacing defined between their peripheral surfaces **20*a* and 20*b*, said spacing being adjustable. This predetermined spacing is preferably such that a spacing 1 between the peripheral surfaces 20*a* and 21*a* on a straight line L connecting the rotary axes of the perforated cylindrical bodies 20 nd 21 is 1.5–2.5 times the effective length of the mass of fibers. The adjustment of the spacing is made by moving upward or downward the bearing of at least one perforated cylindrical body. The two perforated cylindrical bodies 20 and 21 are driven for rotation so that the opposed peripheral surfaces 20*a* and 21*a* move to the right as viewed in FIG. 1. The reference characters 22A and 22B** denote driving belts.

Pipe-like surction devices 23 and 24 are installed inside the perforated cylindrical bodies 20 and 21 respectively, and are formed with suction ports **23*a* and 24*a* corresponding to predetermined angles $\alpha$ and $\beta$ on the back sides of the peripheral surfaces of the perforated cylindrical bodies 20 and 21. The suction devices 23 and 24 are formed by combining two approximately semicylindrical bodies 23A, 23B and 24A, 24B of slightly different radii in partly overlapping relationship. Thus, the degrees of opening of the suction ports 23*a* and 24*a***, i.e., the angles $\alpha$ and $\beta$ can be optionally adjusted for the purpose of controlling the suction forces, i.e., the rates of suction of fibers.

The adjustment of the degrees of opening (angles $\alpha$ and $\beta$) of the suction ports **23*a* and 24*a* is made by making cylindrical shaft portions 23A*a*, 23B*a*, and 24A*a*, 24B*a* provided on the lateral plates of the semicylindrical bodies 23A, 23B and 24A, 24B project through the cylindrical rotary shafts 20*b* and 21*b* provided on the lateral plates of the perforated cylindrical bodies 20 and 21 and rotating them through respective desired angles. That is, the shaft portions 23A*a* and 24A*a* of the semicylindrical bodies 23A and 23B of larger radius are slidably contacted with the inner peripheral surfaces of the rotary shafts 20*b* and 21*b* of the perforated cylindrical bodies 20 and 21 and project outward, while the shaft portions 23B*a* and 24B*a* of the semicylindrical bodies 23B and 24B of smaller radius are slidably contacted with the inner peripheral surfaces of the shaft portions 23A*a* and 24A*a* associated with the greater radius and project outward. The semicylindrical bodies 23A, 23B and 24A, 24B are rotated at the ends of the shaft portions 23A*a*, 23B*a* and 24A*a*, 24B*a* until the suction ports 23*a* and 24*a* are adjusted to predetermined degrees of opening. In the overlapping portions of the two semicylindrical bodies 23A, 23B and 24A, 24B, seal members 23B*b* and 24B*b* are attached to the ends of the semicylindrical bodies 23B and 24B to be adapted for slide contact with the inner peripheral surfaces of the other semicylindrical bodies 23A and 24A to keep them airtight. The cylindrical shaft portions 23B*a* and 24B*a* are communicated with a suction fan (not shown). The reference characters 20*c* and 21*c* denote ball bearings which support the rotary shafts 20*b* and 21*b*, and 20*d* and 21*d*** denote driving chain wheels.

An electrostatic generator 25 for generating high voltage negative static electricity is connected to the peripheral surface **21*a* of the perforated cylindrical body 21 through a connection terminal 26, while the peripheral surface 20*a* of the other perforated cylindrical body 20 is grounded as at 28 through a connection terminal 27. The rotation-upstream sides (left-hand side in FIG. 1) of the opposed peripheral surfaces 20*a* and 21*a* of the perforated cylindrical bodies 20 and 21 are connected to the feed duct 18*b* ot the fiber mass opening and feeding device 18**.

A linear conveyor belt 29 traveling at the same surface speed as that of the perforated cylindrical body 20 and contacted at one end thereof with the peripheral surface **20*a* of the perforated cylindrical body 20 adjacent the line L connecting the axes of the perforated cylindrical bodies 20 and 21 is disposed in a direction which is at right angles to the line L. On the upper surface of the conveyor belt 29, there is a nip belt 30 contacted at one end thereof with the perforated cylindrical body 20 and moving with said conveyor belt 29. Therefore, it is possible to doff a mass of fibers in web form from the peripheral surface of the perforated cylindrical body 20 and withdraw it in a direction at right angles to the line L as it is held between the belts 29 and 30**.

The cylindrical bodies 20 and 21 are formed, for example, of perforated metal plate, perforated netting, electrically conductive perforation rubber sheet or the like, preferably the diameter of the through hole being 2–6 mm and the opening ratio being 40–60%.

In the series of devices described above, a lap is fed to the carding machine 11 by the feed roller 12 and is carded by the taker-in roller 13, cylinder 14 and flats 15 by means of their card clothing to thereby open them into single fibers while removing impurities and deposit them in the form of a web on the surface of the doffer 16. The web on the surface of the doffer 16 is continuously doffed by the doffing roller 18A of the fiber mass opening and feeding device 18 in the next process, the doffed web being opened into single fibers by the opening roller 18B. The mass of fibers opened into single fibers are fed from the feed duct **18*b* into between the peripheral surfaces of the perforated cylindrical bodies 20 and 21 of the fiber removing device 17. At this time, with negative static electricity of high voltage (usually 30,000–50,000 volts) applied across the peripheral surfaces 21*a* and 21*b*, the suction devices 23 and 24 for the perforated cylindrical bodies 20 and 21 are operated. The perforated cylindrical bodies 20, 21, conveyor belt 29, and nip belt 30** are kept driven.

Fibers fed are oriented as they are gradually stretched under the action of electrostatic attractive force and suction force in the gradually narrowed space between the peripheral surfaces **20*a* and 21*a* of the perforated cylindrical bodies 20 and 21. At this time, those fibers which are relatively long are connected together to bridge the space between the perforated cylindrical bodies 20***a* and 21*a* and held in point contact manner on the peripheral surfaces 20*a* and 21*a;* they never close the through holes. Short fibers make floating action while reciprocating between the peripheral surfaces 20*a* and 21*a* under the action of electrostatic attractive force, without being connected together in bridge relationship, and when they are floating while reciprocating, they are passed through the through holes in the peripheral surfaces 20*a* and 21a, sucked through the suction ports 23*a* and 24*a* into the suction devices 23 and 24 and discharged. Long fibers held between the peripheral surfaces 20*a* and 21*a* are moved to the rotation-downstream side together with the perforated cylindrical bodies 20 and 21, and transferred from the peripheral surface 20*a* of the cylindrical body 20 to adhere to one end 29*a* of the conveyor belt 29 adjacent the downstream side of the narrowest region between the peripheral surfaces 20*a* and 21*a*. Then the long fibers, in the lengthwise oriented state, are arrested at one of their respective ends by the conveyor belt 29 and doffed in the form of a web, which, held between the conveyor belt 20 and the nip belt 30, and are moved in a direction at right angles to the line L. And, as shown in FIG. 3, the web, while being condensed by a trumpet 31, is withdrawn as a sliver by calendar rollers 32 and received in a can 34 through a coiler 33.

On the basis of the method described above, cotton having a fineness of 1.5 deniers and an effective fiber length of 30 mm was treated under the conditions that the spacing 1 between the peripheral surfaces of the perforated cylindrical bodies 20 and 21 was 60 mm, that the applied voltage was −45 kV, that the suction air current flow rate was 0.2 $m^3/s$, that the rotating speed of the opening roller 18B was 2600 rpm, and that the surface speed of the belt conveyor 29 was 20 m/min. As a result, the obtained bunch of fibers (sliver) had its short fibers removed to the content of 16% as same extent as that attained by comber treatment even when the short fiber content in the card web was about 27%. Moreover, the lengthwise orientation of fibers was very good, with no hooks formed, and there was no mechanical force as damaged fibers. Thus, the difficulty of removal of short fibers which has been a drawback of the conventional carding machine has been eliminated. Besides, conventional combing process after carding process has been eliminated.

In the doffing of a web from the doffer of the conventional carding machine, gain control of slivers makes it necessary to make the doffer and the doffing rolller approximately equal in surface speed to each other, resulting in insufficiency of doffing capacity, with the result that there has been a problem that webs tend to twine around the doffer and doffing roller. However, in the above embodiment, in the doffing roller 18A of the fiber mass opening and feeding device 18, the web can be doffed at a surface speed greater than in the doffer 16, there is no danger of the web twining around the doffer 16. Further, since fibers are opened and fed between the perforated cylindrical bodies 20 and 21 by the opening roller 18B, the rate of feed of fibers can be accurately and easily measured; thus, there is a merit that control of the amount of fibers to be treated is facilitated.

In the short fiber removing device 17, the conveyor belt 29 is disposed in a direction at right angles to the line L and not only the conveyor belt 29 but also the nip belt 30 is contacted at one end thereof with the peripheral surface 20*a;* therefore, the doffing of webs from the peripheral surface 20*a* of the perforated cylindrical body 20 is smoothly effected. Thus, there is no danger of fibers remaining on the peripheral surface 20*a* as they strick thereto or twine therearound, nor is the danger of disturbing the fiber orientation of webs.

Instead of feeding a lap to the carding machine 11, cotton may be fed thereto by a chute or by a hopper. As for the carding machine 11, besides a single card it may be a tandem card or any other type now in use. The control devices; dust collecting devices or the like of the carding machine 11 and the short fiber removing device 17 may be connected together.

In the short fiber removing device, besides effecting the removal of short fibers by directly connecting it to the carding machine 11 in the manner described above, it can be easily applied to fiber tufts, slivers and webs in any desired process. Particularly, in the case of mixture of dissimilar fibers, the invention is very useful for uniform mixing. A mass of fibers withdrawn from the short fiver removing device 17 may be fed again to the carding machine 11, whereby waste and naps can be more effectively removed.

In the above embodiment, the short fiber suction devices 23 and 24 are such that the degree of opening of the suction ports 23*a* and 24*a* is adjustable; however, such degree of opening may be fixed at a given value, and if the degree of opening must be changed for some reason, such as the change of the fiber sort, the suction device may be replaced by another having its degree of opening set to a desired value. The suction devices 23 and 24 have been provided for both of the perforated cylindrical bodies 20 and 21; however, such section device may be provided for only one of them. Alternatively, one of the perforated cylindrical bodies 20 and 21 may be provided with a suction device, while the other may be designed to spout a slow stream of air. The static electricity to be applied across the perforated cylindrical bodies 20 and 21 may be positive or negative or may be alternately positive and negative. Alternatively, positive static electricty may be applied to one perforated cylindrical body and negative static electricity to the other.

Figure 4:
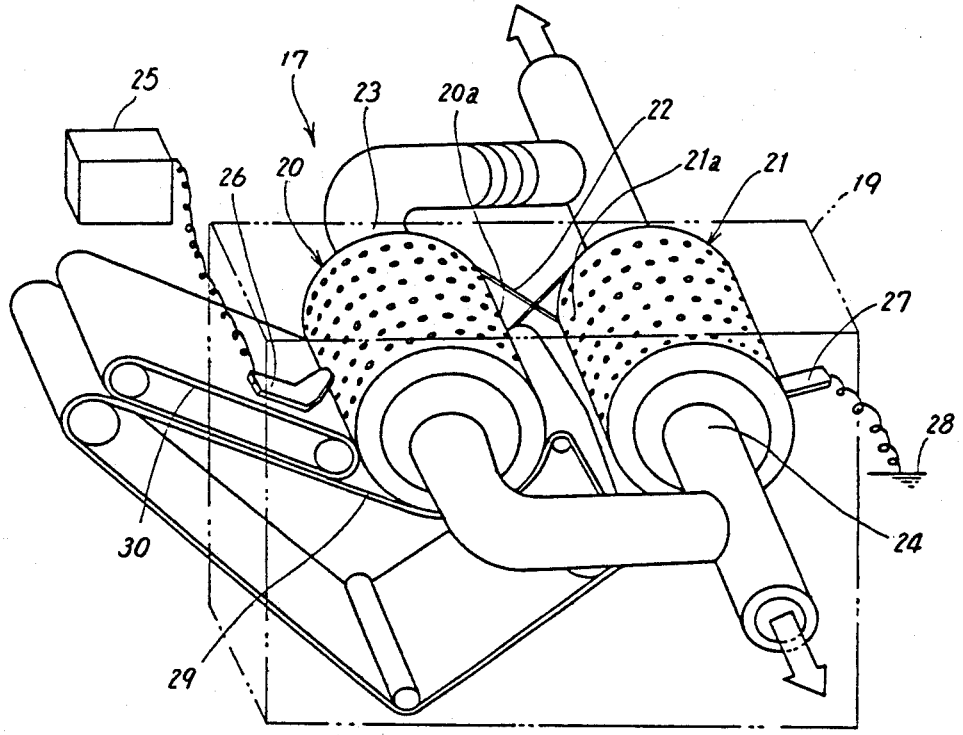
FIG. 4 is a schematic perspective view of a second embodiment of a short fiber removing device of the invention.
Figure 5:
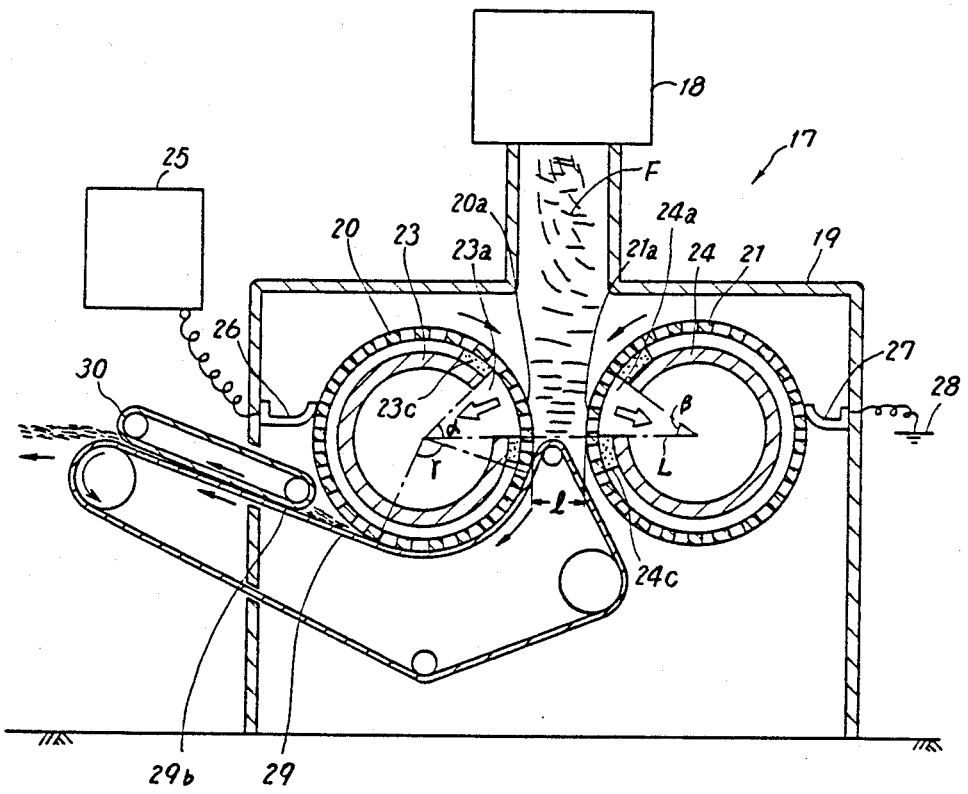
FIG. 5 is a schematic perspective view of the deivce of FIG. 4.

A second embodiment of the invention will now be described with reference to FIGS. 4 and 5.

In this embodiment, the perforated cylindrical bodies 20 and 21 of the short fiber removing device 17 are disposed side by side in parallel relationship with their rotary axes extending horizontal. As in the first embodiment, the predetermined spacing between their peripheral surfaces 20*a* and 20*b* is adjustable. The perforated cylindrical bodies 20 and 21 are driven for rotation in such a manner that the opposed peripheral surfaces 20*a* and 21*a* travel downward. The numeral 22 denotes a drive belt.

The suction devices 23 and 24 in this embodiment are in the form of pipes. The suction devices 23 and 24 are formed with suction ports 23*a* and 24*a* within the range of predetermined angles $\alpha$ and $\beta$ (30–60 degrees) upwardly of the line L connecting the axes of the perforated cylindrical bodies 20 and 21. The reference characters 23*c* and 24*c* denote seal members.

The fiber mass opening and feeding device 18 is installed above the opposed peripheral surfaces 20*a* and 21*a* of the perforated cylindrical bodies 20 and 21. The conveyor belt 29 for delivering a mass of fibers is moved in contact with the associated peripheral surface 20*a* in the range of an angle $\tau$ (in this embodiment, about 90 degrees) in the rotationdownstream side of the perforated cylindrical body 20 from adjacent the line L, the direction of movement of said conveyor belt being the same as that of the perforated cylindrical body 20. After being released from contact with the peripheral surface 20*a* of the perforated cylindrical body 20, the conveyor belt 29 is guided approximately linearly outwardly of the frame 19. Therefore, the mass of fibers fed between the perforated cylindrical bodies 20 and 21 and having the short fibers removed therefrom are conveyed by the conveyor belt 29 as they are held between the conveyor belt 29 and the peripheral surface 20*a* of the perforated cylindrical body 20 and then nipped between the conveyor belt 29 and the nip belt 30, so that they can be delivered outside the device. In addition, the range of contact of the perforated cylindrical body 20 with the conveyor belt 29 may be set so that the corresponding angle $\tau$ is within 90 degrees.

In the short fiber removing device of such construction, with static electricity of high voltage applied across the peripheral surfaces 20*a* and 21*a* of the perforated cylindrical bodies 20 and 21, with the suction devices 23 and 24 operated and with the perforated cylindrical bodies 20 and 21 and the conveyor belt 29 and nip belt 30 kept driving, a mass of fibers are fed from the fiber mass opening and feeding device 18.

Thereupon, fibers F are oriented as they are gradually stretched under the action of electrostatic attractive force and suction force in the gradually narrowed space between the peripheral surfaces 20*a* and 21*a* of the perforated cylindrical bodies 20 and 21, and those fibers which are relatively long are connected together to bridge the space between the perforated cylindrical bodies 20*a* and 21*a* and held in point contact manner on the peripheral surfaces 20*a* and 21*a*; they never close the through holes. Short fibers make floating action while reciprocating between the peripheral surfaces 20*a* and 21*a* under the action of electrostatic attractive force, without being connected together in bridge relationship, and when they are floating while reciprocating, they are passed through the through holes in the peripheral surfaces 20*a* and 21a, sucked through the suction ports 23*a* and 24*a* into the suction devices 23 and 24 and discharged. Long fibers held between the peripheral surfaces 20*a* and 21*a* are moved downward with the perforated cylindrical bodies 20 and 21 and are arrested as they are lengthwise oriented between the peripheral surface 20*a* of the perforated cylindrical body 20 in the vicinity of the narrowest region of the space between the perforated cylindrical bodies 20 and 21. And the long fibers are conveyed as they are nipped in this manner. After the contact between the conveyor belt 29 and the peripheral surface 20*a* of the perforated cylindrical body 20 has been canceled, the long fibers are delivered outside as they are nipped between the conveyor belt 29 and the nip belt 30.

What is claimed is:

1. A device for removing short fibers from a mass of fibers comprising:

a pair of perforated cylindrical bodies opposed to each other with a predetermined spacing therebetween, means disposed in the rotation-upstream side of the opposed region of said pair of perforated cylindrical bodies, said means being capable of feeding said mass of fibers, means applying static electricity of high voltage across said pair of perforated cylindrical bodies so as to orient and hold long fibers contained in said mass of fibers approximately perpendicularly to the peripheral surfaces of the perforated cylindrical bodies, while reciprocating short fibers contained in said mass of fibers between the perforated cylindrical bodies, means disposed inside at least one of said perforated cylindrical bodies for removing by suction said short fibers reciprocating between said perforated cylindrical bodies through the perforations therein, and conveyor means for delivering the mass of fibers, having the short fibers removed therefrom, from the surface of one perforated cylindrical body adjacent said opposed region while maintaining them in said oriented state.

2. A short fiber removing device as set forth in claim 1, wherein said suction-wise removing means comprises a suction pipe inserted in each perforated cylindrical body, said pipe having a suction port for creating a suction air current.

3. A short fiber removing device as set forth in claim 2, wherein said suction-wise removing means comprises a pair of rotatable semicylindrical bodies of slightly different radii combined together to form a pipe and a suction port, the degree of opening of the suction port being adjustable by rotating said pair of semicylindrical bodies relative to each other.

4. A short fiber removing device as set forth in claim 1, wherein said conveyor means is contacted at one end thereof with the surface of one perforated cylindrical body in the rotation-downstream side adajacent the opposed region and is capable of conveying fibers in a direction at right angles to a line connecting the axes of the perforated cylindrical bodies.

5. A short fiber removing device as set forth in claim 1, wherein said conveyor means is capable fo coneying fibers from adjacent the middle of the opposed region along the rotation-downstream side of peripheral surface of one perforated cylindrical body.

6. A short fiber removing device as set forth in claim 1, wherein said conveyor means comprises a conveyor belt, along which a nip belt is disposed, so that a mass of fibers can be nipped between the conveyor belt and the nip belt.

7. A short fiber removing device as set forth in claim 1, wherein the pair of perforated cylindrical bodies are disposed in parallel relationship side by side or one above the other with their rotary axes extending horizontal, with a predetermined spacing defined therebetween, said spacing being adjustable.

8. A short fiber removing device as set forth in claim 1, wherein the perforated cylindrical bodies are formed of perforated metal plate, perforating netting or electrically conductive perforation rubber sheet.

9. A short fiber removing device as set forth in claim 1, wherein the means for feeding a mass of fibers to the opposed region comprises a carding machine having a doffer, and a fiber mass opening and feeding device which doffs a fiber web from said doffer and which opens the doffed web into single fibers and feeds the latter to said opposed region.

* * * * *